US006345447B1

(12) United States Patent
Rönkkö

(10) Patent No.: US 6,345,447 B1
(45) Date of Patent: Feb. 12, 2002

(54) CHAIN SAW

(75) Inventor: Veijo Rönkkö, Soinlahti (FI)

(73) Assignee: Ponasse Oyl, Vierema (FI)

( * ) Notice: Subject to any disclaimer, the term of this patent is extended or adjusted under 35 U.S.C. 154(b) by 0 days.

(21) Appl. No.: 09/577,378

(22) Filed: May 23, 2000

(30) Foreign Application Priority Data

May 27, 1999 (FI) ..... 991200

(51) Int. Cl.[7] ..... B27B 17/14
(52) U.S. Cl. ..... 30/386; 30/383
(58) Field of Search ..... 30/385, 386, 387, 30/381, 382, 383; 83/816

(56) References Cited

U.S. PATENT DOCUMENTS

| | | | | | |
|---|---|---|---|---|---|
| 3,636,995 | A | * | 1/1972 | Newman | 30/386 |
| 4,819,335 | A | * | 4/1989 | Alexander | 30/386 |
| 5,174,029 | A | | 12/1992 | Talberg | 30/386 |
| 5,353,506 | A | * | 10/1994 | Muller et al. | 30/386 |
| 5,896,670 | A | * | 4/1999 | Gibson et al. | 30/386 |
| 6,237,228 | B1 | * | 5/2001 | Moody | 30/386 |

FOREIGN PATENT DOCUMENTS

| | | |
|---|---|---|
| FI | 945240 | 11/1994 |
| FI | 955114 | 4/1996 |
| FI | 100779 B | 2/1998 |
| SU | 745440 | 7/1980 |
| WO | WO 8201846 | 6/1982 |
| WO | WO 9834768 | 8/1998 |

* cited by examiner

*Primary Examiner*—Hwei-Siu Payer
(74) *Attorney, Agent, or Firm*—Young & Thompson

(57) ABSTRACT

A chain saw includes a chain arranged on a saw flange (5). The chain saw is usually arranged in a multi-purpose head of forestry machinery by a mounting flange (1) immobile in regard to the multi-purpose head, whereby the chain is rotated by a chain wheel (4) controlled by a power unit. In order to tighten the chain, the saw flange, or a relevant part of the chain saw comprising the same, is arranged to move parallel with the longitudinal axis (A) of the saw flange in regard to the chain wheel. This is achieved by a tightening device and at least one supporting guide therein which are attached to the mounting flange of the chain saw or a structure arranged therein. By arranging the supporting guide in the tightening device to extend onto both sides of the center of the chain wheel parallel with the longitudinal axis of the saw flange, the saw flange is made to move in a completely supported manner parallel with its longitudinal axis in regard to the chain wheel.

20 Claims, 3 Drawing Sheets

FIG. 5
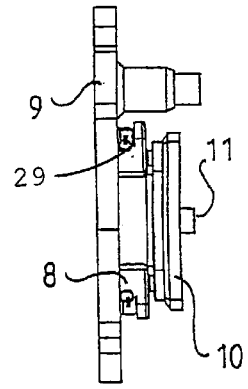
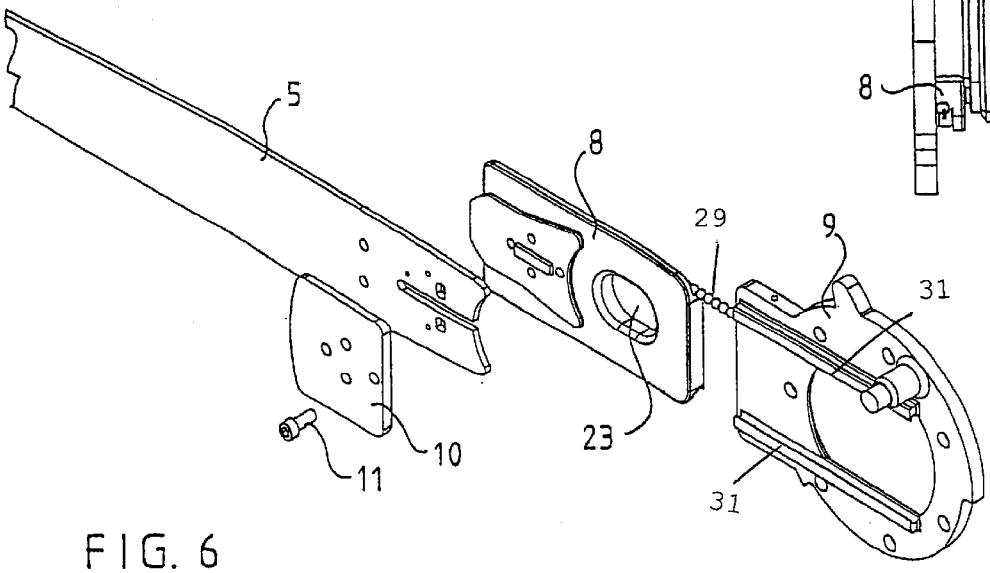
FIG. 6
FIG. 7
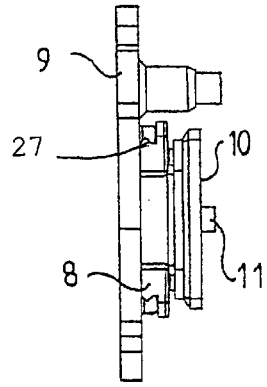
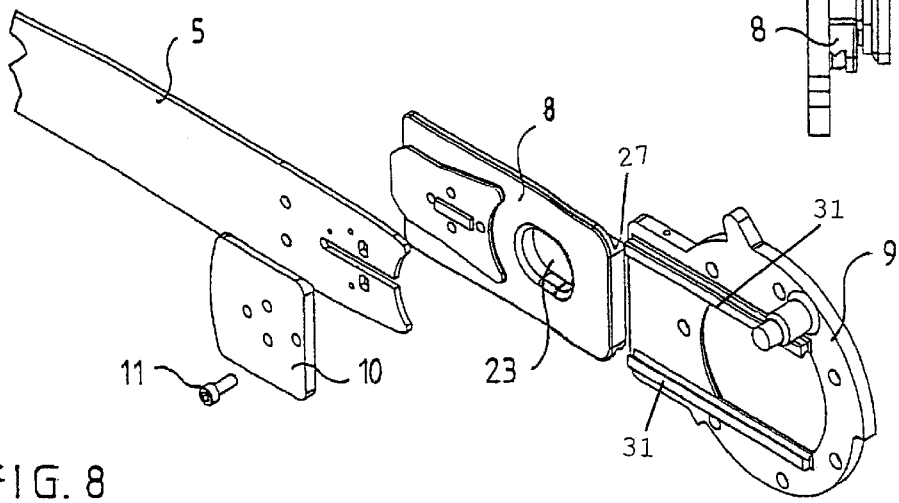
FIG. 8

CHAIN SAW

FIELD OF THE INVENTION

The present invention relates to a device for tightening a chain used in a chain saw. Preferably, the invention relates to automatic tightening of a chain of a chain saw used in a multi-purpose head of a harvester.

BACKGROUND OF THE INVENTION

FI 945 240, FI 100 779, WO 98/34 768 and SU 745 440, for example, disclose related inventions.

The prior art, however, suffers from considerable disadvantages. It has thus been problematic to provide a sufficiently simple, reliable and durable structure of the tightening device. The existing solutions also suffer from great difficulties in solving, in a sufficiently reliable manner, both the tightness of oil and fluid channels in the chain saw and the sufficiently small tolerances between the parts of the device ensuring accurate and reliable operation of the chain saw.

In the known solutions, the tightening device attaching the saw flange to the chain saw is supported by the bearing piece only on one side of the axle of the motor controlling the saw. Hence, the guides enabling the tightening movement of the saw flange have to be short in order for the parts of the tightening device not to overlap the saw flange too much so as not to extremely disadvantageously shorten the effective length of the saw flange of the chain saw, and, thus, the effective sawing diameter.

BRIEF DESCRIPTION OF THE INVENTION

An object of the invention is thus to provide a novel solution so as to enable the above-mentioned problems to be alleviated. Such a device of the invention is reliable and durable, efficiently preventing environmentally harmful substances from being discharged to the environment from the tightening device. The solution of the invention also provides the chain saw with as long an effective sawing diameter as possible.

In a preferred embodiment of the invention, an elongated opening or a slit, in which the axle of the motor controlling the chain can be arranged, is arranged in the tightening device receiving the flange of the saw, thus enabling, however, the mounting piece to move with respect to the axle of the motor. In this manner, the supporting points between the tightening device and the bearing piece connecting the device to the frame of the multi-purpose head can be arranged parallel with the longitudinal axis of the flange on both sides of the axle of the motor.

Considerable advantages are achieved by the invention. The supporting points of the tightening device of the saw flange can thus be dimensioned lighter while they simultaneously allow relatively greater manufacturing tolerances or wear before the operation of the chain saw deteriorates. Hence, the device of the invention can be made more resistant to wear and great forces than the known solutions.

When the device of the invention is used, necessary maintenance intervals can be longer, so the device significantly affects the working efficiency of forestry machinery by reducing inoperative time due to maintenance.

BRIEF DESCRIPTION OF THE DRAWINGS

In the following, the invention will be described with reference to a preferred embodiment of the invention according to the accompanying drawings, in which FIG. 5 shows a tightening device equipped with a supporting guide equipped with a ball bearing, as seen from behind, FIG. 6 shows an exploded view of the supporting guide according to FIG. 5 as seen diagonally from behind, FIG. 7 shows a tightening device equipped with a form-milled supporting guide, as seen from behind, and FIG. 8 shows an exploded view of the supporting guide according to FIG. 7, as seen diagonally from behind.

DETAILED DESCRIPTION OF THE APPARATUS

Figure 1:
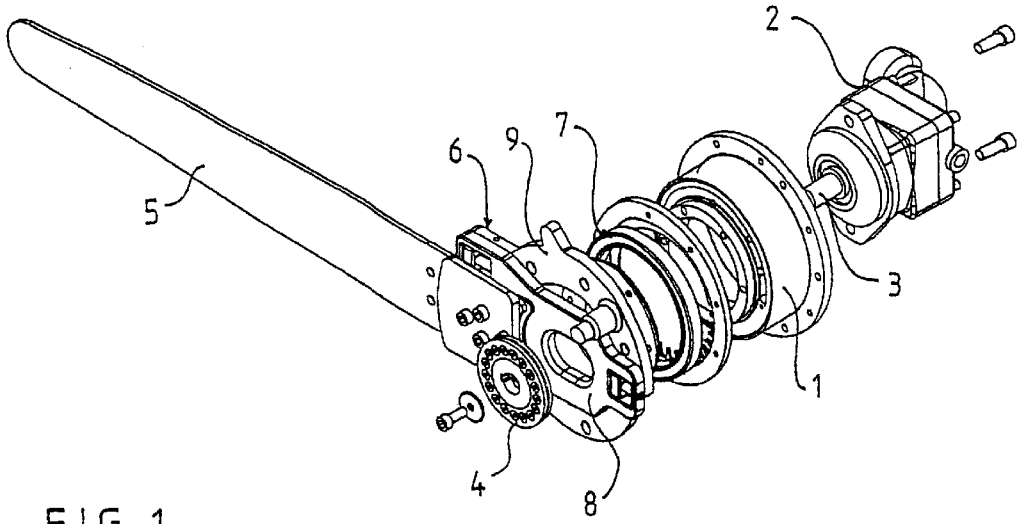
FIG. 1 is a general exploded view of the structure of a chain saw equipped with a tightening device.

The drawings show a preferred embodiment of a chain saw. Such a chain saw comprises parts which will be shown in the following, the parts being equipped with the reference numbers shown in the figures. Thus, a saw apparatus is attached to a frame (not shown) of a multi-purpose head arranged particularly in forestry machinery by a mounting flange 1 to be immovably attached to the frame. The chain saw is driven, for example, by a power unit 2, preferably a hydraulic motor, arranged in the frame of the multipurpose head. In accordance with FIG. 1, for example, the power unit drives, via an axle 3 provided therein, a chain wheel 4 in order to rotate a chain arranged on a saw flange 5 in the chain saw. The saw flange is arranged in the chain saw by a tightening device 6, which is rotatably arranged in the mounting flange 1 by a bearing piece 7 in order to turn the saw flange around a pivot axis formed by the axle of the power unit. With such a tightening device, the saw flange is made to move parallel with its longitudinal axis in order to tighten the chain. The tightening device comprises a mounting piece 8 immovably arranged on the saw flange, and a mounting frame 9 rotatably arranged on the bearing piece. The mounting piece and the mounting frame are slidably arranged with respect to each other, being supported by guides, thus enabling the saw flange to move parallel with its longitudinal axis with respect to the mounting frame and, further, the frame of the multi-purpose head. The saw flange 5 is rigidly attached to the mounting piece by a mounting plate 10, which is pressed against the saw flange by means of screws 11 in a manner known per se, for example.

Figure 2:
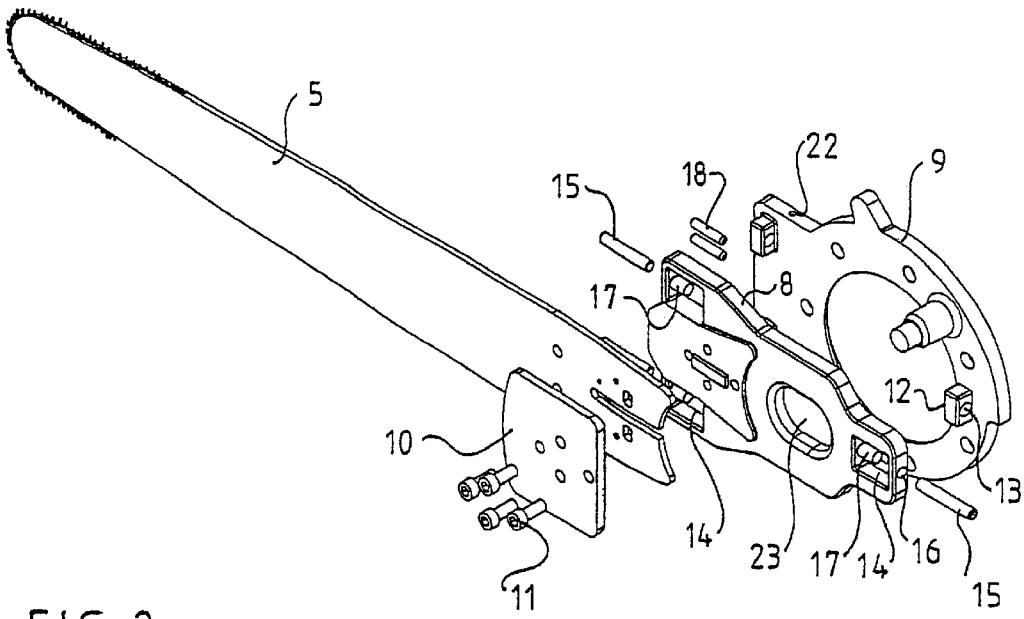
FIG. 2 is an exploded view of the chain saw according to FIG. 1 as seen diagonally from behind.
Figure 3:
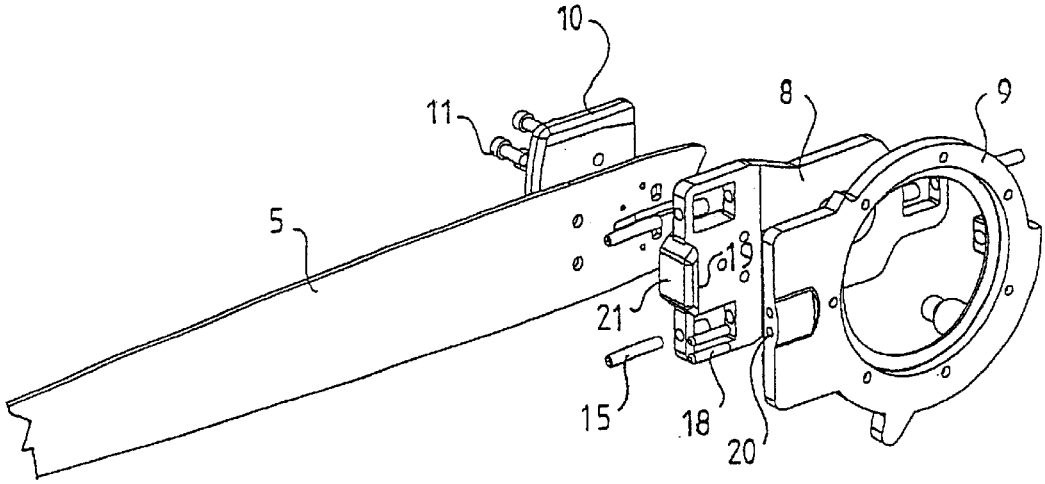
FIG. 3 shows an exploded view of the chain saw according to FIG. 1 as seen diagonally from the front.

When the mounting piece 8 is allowed to move a certain distance parallel with the longitudinal axis A of the saw flange in regard to the bearing piece of the chain saw, the saw flange 5 is thus arranged to draw away from the longitudinal section plane B of the axle of the power unit (see FIG. 4), the chain arranged on the saw flange tightening simultaneously. Such a controlled movement of the saw flange 5 is enabled by the supporting guides in the tightening device. Such supporting guides particularly comprise, in the preferred embodiment according to FIGS. 2 and 3, for example, at least two guiding means 12 located in the mounting frame 9 and protruding from the outer surface thereof towards the mounting piece 8, the guiding means 12 comprising openings 13 parallel with the longitudinal axis of the saw flange 5. Slide openings 14 receiving the guiding means 12 are, in turn, arranged in the mounting piece 8.

When the mounting frame 9 and the mounting piece 8 are arranged together to form the tightening device 6, the guiding means 12 are arranged within the slide openings 14. Furthermore, slide pins 15 are arranged in the openings 13 of the guiding means 12, the slide pins 15 preferably being immovable in regard to the slide openings 14, thus preventing the guiding means 12 from being removed from the slide openings 14. Such a structure has been achieved, for example, by arranging mounting holes 16 in the opposite and substantially perpendicular walls of the slide opening 14 in regard to the saw flange. These mounting holes 16 are substantially parallel with the opening 13 in the guiding means 12, forming an extension of the longitudinal axis of the opening 13 of the guiding means 12 when arranged in the slide opening 14. A sliding-bearing bushing 17 has been arranged in at least one of such a mounting opening such that by pushing the slide pin 15 into the mounting holes 16 of the mounting piece 8 and, further, into the sliding-bearing bushing 17 therein, simultaneously guiding the slide pin 15 by the opening 13 in the guiding means 12 of the mounting frame 1, a supporting guide is achieved by which the mounting piece 8 is supported, moving on the sectional plane of the saw flange 5 parallel with its longitudinal axis in regard to the mounting frame 9.

By the present device, the chain of a chain saw can be tightened by utilizing pressure of the hydraulic fluid supplied to the device. Thus, by, for example, supplying reduced pressure from a pressure reducer serving a functionality of the multi-purpose head, a continuous tightening function is achieved. To achieve such a tightening function, pistons 18 are arranged to direct a propulsive force against the mounting piece 8 and a counter-surface 19 preferably arranged therein, forcing the mounting piece 8 and the saw flange 5 away from the center of the saw.

The piston structure of the invention is achieved in the mounting frame 9 by, for example, boring therein piston holes 20 parallel with the longitudinal axis of the saw flange 5. The holes 20 preferably extend a distance from the outer surface of the mounting frame 9 towards the mounting frame 9. The pistons 18 are arranged into these holes 20, and the pistons 18 come into contact with the counter-surface 19 in a counter-part 21 of the mounting piece 8, the counter-surface 19 extending to the piston holes 20. The pressure of hydraulic fluid is conveyed to the cylinders thus formed via, for example, a pressure hole 22 in the mounting frame 9, using a hydraulic duct arranged therein. When the pistons 18 come into contact with the counter-piece 19 of the mounting piece 8 at their other end, the hydraulic fluid pressure produces a movement which pushes the mounting piece 8 and the saw flange 5 rigidly arranged thereon, thus tightening the chain rotating around the saw flange.

In previous chain saw solutions, the mounting piece 8 arranged in the saw flange 5 has been arranged to be supported against the mounting frame 9 only on one side of the longitudinal section plane B of the axle extending from the power unit 2. Hence, the supporting guides 12 enabling the tightening movement of the saw flange have to be built considerably short in order for the parts of the mounting piece 8 and the mounting frame 9 not to shorten the effective cutting length of the chain saw too much.

Figure 4:
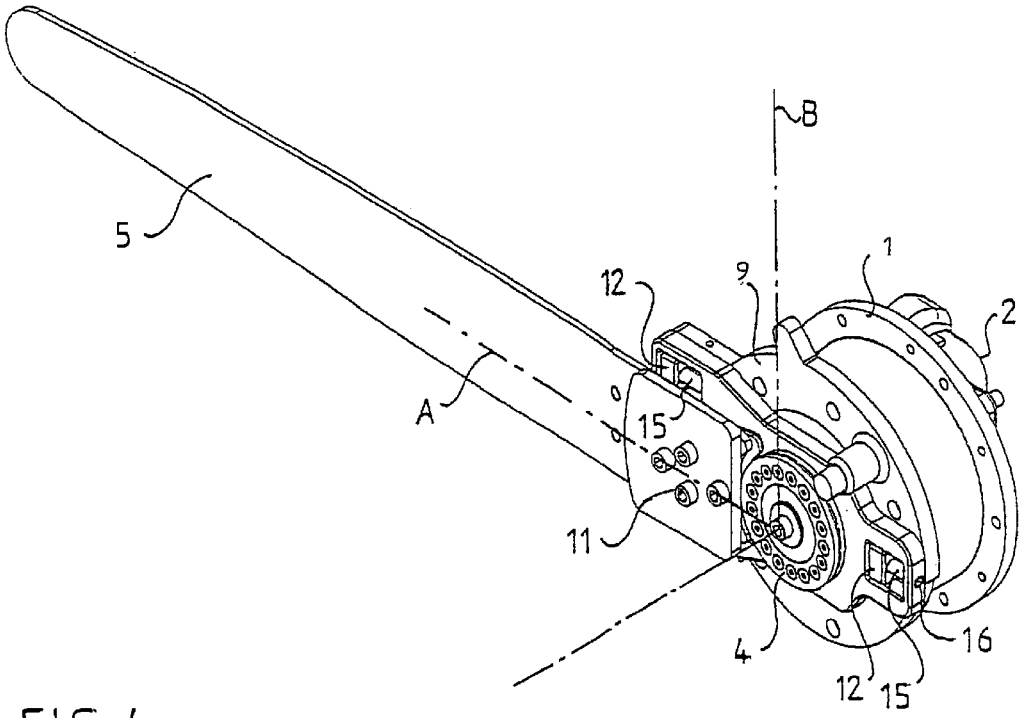
FIG. 4 shows the chain saw according to FIG. 1 when assembled, as seen diagonally from behind.

Instead, the present solution comprises two or more supporting points between the mounting piece 8 and the mounting frame 9 arranged, according to FIG. 4, on the opposite sides of the longitudinal section plane B of the axle 3 extending from the power unit 2 parallel with the longitudinal axis A of the saw flange 5. Consequently, the supporting guides 12 of the tightening device 6 are located at a distance from each other, which means that they can receive considerably greater torque forces deflecting the saw flange 5 than would be the case if the points were located near each other on the same side of the axis.

Hence, in order to enable the saw flange 5 to move, an elongated opening 23 receiving the axle 3 is arranged in the mounting piece 8 parallel with the longitudinal axis A of the saw flange 5. It is thus ensured that the axle 3 continuously comes into contact with the chain wheel regardless of the movements of the saw flange 5. The supporting guides 12 of the tightening device 6 can then be dimensioned lighter than before while they also allow greater manufacturing tolerances or wear before the operation of the chain saw deteriorates too much.

It is to be understood that the above description and the related drawings are only intended to illustrate the present invention. The invention is thus not restricted only to the embodiment disclosed above or defined in the claims, but it will be obvious to one skilled in the art that the invention can be modified in many ways within the scope of the inventive idea disclosed in the attached claims.

Hence, although the figures and the description set forth a supporting guide solution, i.e. a circular guide, equipped with so-called stub axles and sliding sleeves, it is obvious to one skilled in the art that solutions disclosed in demonstrations and textbooks in the field, such as different form-milled grooves 27, e.g. a dovetail joint with or without a slide bearing, can also be used as the guide solution, as shown in FIGS. 7 and 8. Also grooves cut in the parts, for example, can be used into which balls 29 or reels are arranged via a hole, in which case they operate in a manner of a ball screw or a guide, as shown in FIGS. 5 and 6. The tightening device of the invention also comprises at least one supporting guide 31 which can be arranged to extend onto the both sides of the axle of the power unit parallel with the longitudinal axis of the saw flange, which considerably increases the strength of the supporting guide. The number of the supporting guides in the tightening device may also vary considerably, depending on the chosen solution method. On the other hand, the mounting frame of the tightening device may be, according to the above embodiment, a separate structural part or it can be part of the bearing piece arranged in the mounting flange. Furthermore, in order to make the replacement of the saw flange easier and quicker, the saw flange can be arranged in the mounting piece using a push-pull device known per se. Channels, which are not separately shown in the figures, can also be arranged in the mounting piece and the mounting plate for different fluids, such as chain lubrication oil and stump treatment agent, to be supplied to the saw flange and the saw side.

The tightening of the chain has been shown, according to the present embodiment of the invention, to be arranged by means of the hydraulic pressure supplied into the tightening device. The force necessary for the tightening can, however, be obtained either by a spring or a gas spring, for example.

What is claimed is:

1. A chain saw comprising a chain rotated by a power unit, whereby the chain is arranged onto a saw flange (5) controlling the chain, wherein the chain is controlled by a chain wheel (4) controlled by the power unit; the saw flange being pivotally mounted on a mounting flange by a tightening device (6) arranged on the saw flange and a bearing piece (7) arranged on the tightening device in order to turn the saw flange on the plane of the mounting flange, whereby the tightening device is arranged to make the saw flange move parallel with its longitudinal axis (A) in order to tighten the chain, the tightening device comprising a mounting piece (8) immovably arranged on the saw flange and a mounting frame (9) arranged on the bearing piece, the mounting piece and the mounting frame being slidably arranged with respect to each other, wherein the mounting piece and the mounting frame supporting the saw flange (5) are interconnected by at least one supporting guide having parts on both sides of a center of the chain wheel (4) and parallel with the longitudinal axis (A) of the saw flange, thus enabling the saw flange to move parallel with its longitudinal axis (A) in regard to the chain wheel.

2. A chain saw as claimed in claim 1, wherein the number of the at least one supporting guide is two.

3. A chain saw as claimed in claim 2, wherein the chain is controlled by the chain wheel (4) controlled by the power unit through an axle (3) extending from the power unit to the chain wheel, wherein the mounting piece (8) and the mounting frame (9) are shaped to receive the axle (3), simultaneously enabling the saw flange (5) to move parallel to its longitudinal axis (A) with respect to a longitudinal section plane (B) of the axle (3).

4. A chain saw as claimed in claim 3, wherein the mounting piece (8) and the mounting frame (9) comprise means (23) for receiving the axle (3).

5. A chain saw as claimed in claim 4, wherein the means for receiving the axle are openings.

6. A chain saw as claimed in claim 4, wherein the means for receiving the axle are slits.

7. A chain saw as claimed in claim 1, wherein the chain is controlled by the chain wheel (4) controlled by the power unit through an axle (3) extending from the power unit to the chain wheel, wherein the mounting piece (8) and the mounting frame (9) are shaped to receive the axle (3), simultaneously enabling the saw flange (5) to move parallel to its longitudinal axis (A) with respect to a longitudinal section plane (B) of the axle (3).

8. A chain saw as claimed in claim 7, wherein the mounting piece (8) and the mounting frame (9) comprise means (23) for receiving the axle (3).

9. A chain saw as claimed in claim 8, wherein the means for receiving the axle are openings.

10. A chain saw as claimed in claim 8, wherein the means for receiving the axle are slits.

11. A chain saw as claimed in claim 8, wherein the means for receiving the axle is elongated and substantially parallel with the longitudinal axis (A) of the saw flange (5).

12. A chain saw as claimed in claim 7, wherein said at least one supporting guide comprises a bar that extends parallel with the longitudinal axis (A) of the saw flange (5) onto both sides of the longitudinal section plane (B) of the axle (3).

13. A chain saw as claimed in claim 1, wherein said at least one supporting guide comprises two circular guides.

14. A chain saw as claimed in claim 13, wherein said at least one supporting guide comprise at least two guiding means (12) in the mounting frame (9) and which protrude from the outer surface thereto toward the mounting piece (8) and which comprise openings (13) substantially parallel with the longitudinal axis of the saw flange (5) such that the guiding means are arranged in slide openings (14) located in the mounting piece and equipped with substantially perpendicular walls in regard to the saw flange, whereby the guiding means and the slide openings are locked together by slide pins (15) arranged in mounting holes (16) arranged in the opposite walls of the slide openings (14), the mounting holes (16) being co-linear with the openings (13).

15. A chain saw as claimed in claim 14, wherein a sliding-bearing bushing (17) has been arranged in at least one of said mounting holes (16).

16. A chain saw as claimed in claim 1, wherein the at least one supporting guide comprises a form-milled groove and a bar or a projective part.

17. A chain saw as claimed in claim 1, wherein the at least one supporting guide comprises grooves in the mounting piece (8) and the mounting frame (9), balls or reels having been arranged in the grooves.

18. A chain saw as claimed in claim 1, wherein the reciprocal movement of the mounting piece (8) and the mounting frame (9) is controlled by a piston-cylinder arrangement arranged therein.

19. A chain saw as claimed in claim 18, wherein the piston-cylinder arrangement comprises at least one piston hole (20) arranged in the mounting frame (9) and substantially parallel with the longitudinal axis (A) of the saw flange (5), a pin being in said piston hole to produce a piston, whereby the opposite end of the piston comes into contact with a plane (19) in the mounting piece (8) substantially transverse in regard to the direction of movement of the saw flange, and that at least one channel (22) is arranged in the at least one piston hole in order to supply pressure medium thereto, whereby the pressure medium supplied to the cylinder formed by the piston hole (20) via the channel pushes the mounting piece (8), and thus the saw flange (5) attached thereto, away from the center in the chain saw.

20. A chain saw as claimed in claim 19, wherein the plane (19) in the mounting piece (8) is arranged in a projective part (21) in the mounting piece.

* * * * *